United States Patent [19]

Marrs

[11] 4,287,631

[45] Sep. 8, 1981

[54] PAINT REMOVER FOR PAINT ROLLERS AND PAINT BRUSHES

[76] Inventor: Carl Marrs, 1831 Bonus Dr., San Diego, Calif. 92110

[21] Appl. No.: 108,505

[22] Filed: Dec. 31, 1979

[51] Int. Cl.[3] ..... A46B 17/06

[52] U.S. Cl. ..... 15/105; 15/104 R; 15/236 R; 15/257 R

[58] Field of Search ..... 15/38, 104 R, 105, 236 R, 15/257 R

[56] References Cited

U.S. PATENT DOCUMENTS

| | | | |
|---|---|---|---|
| 2,295,933 | 9/1942 | Cave | 15/263 |
| 2,724,848 | 11/1955 | Horvath . | |
| 2,761,165 | 9/1956 | Krzanowski | 15/236 R |
| 3,338,076 | 8/1967 | Williams et al. | 68/241 |
| 3,430,286 | 3/1969 | Bownes | 15/257 |

*Primary Examiner*—Edward L. Roberts
*Attorney, Agent, or Firm*—Brown & Martin

[57] ABSTRACT

A spring metal rod is bent in the general shape of an elongated U having opposed concave curves in the sides of the U-shape and having outwardly inclined sides with opposed inwardly bent end bars at the upper portion of the U-shape. The distance between the concave curves in the sides of the U-shape and the closed end of the U-shape is great enough to permit the closed end of the U-shape to be grasped in the hand. The opposed concave sides are used to grip the paint roller while the paint remover is moved parallel to the axis of the roller to squeeze paint out of the roller. The opposed end bars are used to grip the bristles of the paint brush while the paint remover is moved longitudinally with respect to the brush to squeeze paint out of the bristles.

3 Claims, 2 Drawing Figures

PAINT REMOVER FOR PAINT ROLLERS AND PAINT BRUSHES

BACKGROUND OF THE INVENTION

In the past, paint removers for paint rollers and paint brushes have been made separately. The principal object of this invention is to provide a unitary paint remover which can be used on both rollers and brushes.

Another object of this invention is to provide a paint remover that is simple in structure and small in size.

A further object of this invention is to provide a paint remover that is low in cost.

SUMMARY OF THE INVENTION

The paint remover is this invention consists of a rod of spring metal which is bent in the general shape of an elongated U with opposed concave curves in the sides of the U-shape and outwardly inclined sides with opposed inwardly bent end bars at the open portion of the U-shape. The distance between the concave curves in the sides of the U-shape and the closed portion of the U-shape is great enough to permit the closed portion of the U-shape to be grasped in the hand. The opposed concave sides are used to grip a paint roller while the paint remover is moved parallel to the axis of the roller to squeeze paint out of it. The opposed end bars are used to grip the bristles of a paint brush while the paint remover is moved longitudinally with respect to the brush to squeeze paint out of the bristles.

DESCRIPTION OF THE PREFERRED EMBODIMENT

Figure 1:
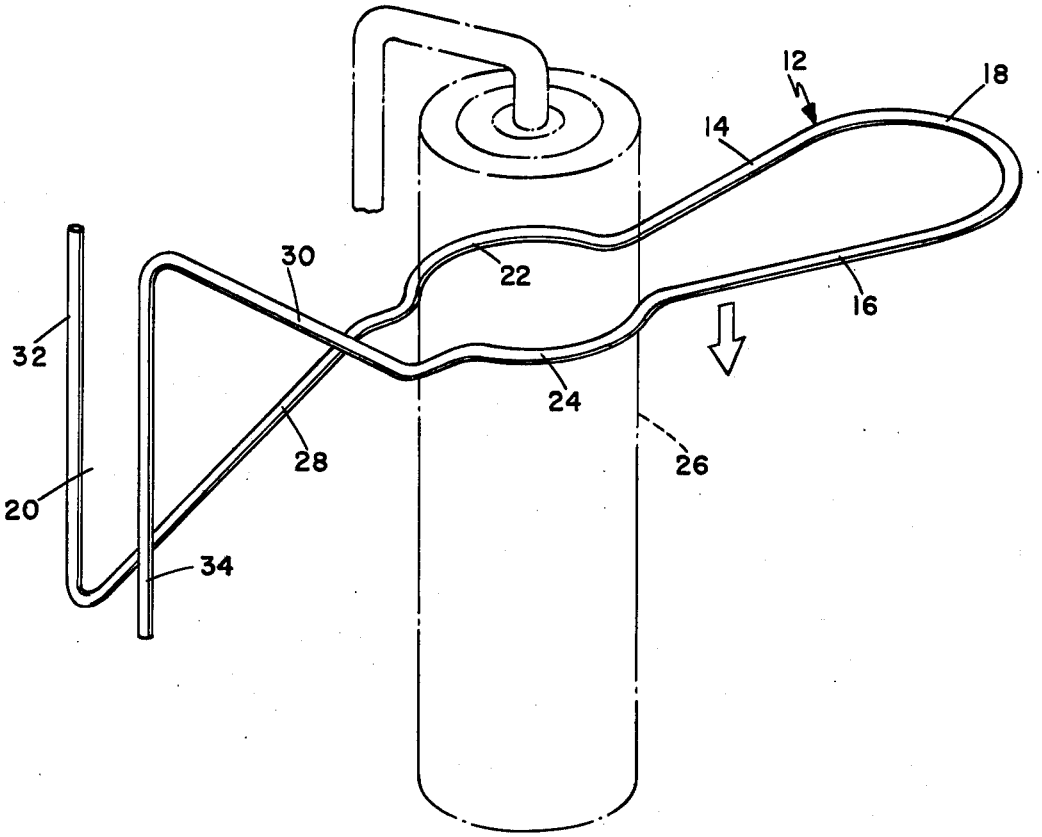
FIG. 1 is a perspective view of the preferred embodiment of the invention being used to strip paint from a paint roller.

Referring to FIG. 1, the preferred embodiment is made of a rod 12 of spring metal (e.g. 3/16" round cold rolled steel, cadmium plated) which is bent in the shape of an elongated U having opposed sides 14 and 16, a closed end 18, and an open end 20. a pair of opposed concave curves 22 and 24 are formed in the central portion of the sides 14 and 16 to grip roller 26 as shown in broken lines. When used to remove paint from a paint roller, the roller 26 is inserted within the U-shape rod between concave curves 22 and 24 transverse to the plane of the U-shape as shown in FIG. 1. The handle portion of the pain remover, which extends from the closed end 18 of the U-shape to the start of concave curves 22 and 24, is grasped in the hand and is squeezed as the paint remover is pulled along the axis of the roller 26 to strip paint out of the roller. The direction of motion of the paint remover is indicated by the arrow in FIG. 1.

Figure 2:
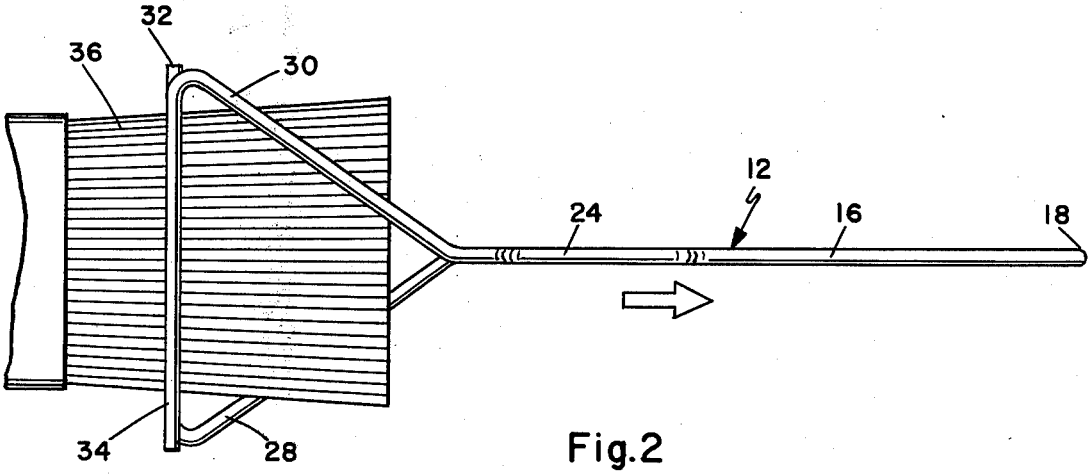
FIG. 2 is a side view of the embodiment of FIG. 1 being used to strip paint from the bristles of a brush.

The open end 20 of the U-shape rod is adapted to strip paint from brushes. It has two outwardly inclined sides 28 and 30 which terminate in inwardly bent end bars 32 and 34 which oppose each other. As shown in FIG. 2, end bars 32 and 34 are longer than the width of the brushes which the tool is designed to clean. To use the tool, the bristles of the brush 36 are inserted between the end bars 32 and 34 and the handle of the paint remover is squeezed as in the case of the roller and the paint remover is moved longitudinally with respect to the axis of the brush to strip paint from the bristles.

Having described my invention, I now claim:

1. A paint remover for paint rollers and paint brushes comprising:

a unitary spring metal rod which is bent in the general shape of an elongated U to define a handle at the closed end of the U-shape, having opposed concave curves in opposite sides of the U-shape for gripping a paint roller inserted within the curves, and having outwardly inclined sides in the open portion of the U-shape with inwardly bent end bars which oppose each other for gripping the bristles of a paint brush;

whereby upon squeezing the handle, the rod squeezes a gripped brush or roller to enhance removal of paint from said bristles or said roller when said brush is pulled from the end bars or when said roller is pulled between the curves of the squeezed rod.

2. The paint remover defined in claim 1 whereas the inwardly bent end bars are perpendicular to the plane of the U-shape.

3. The paint remover defined in claim 1 wherein the handle portion of the rod between the concave curves and the closed end of the U-shape is long enough to be grasped with the hand.

* * * * *